US010480767B2

(12) United States Patent
Callaghan et al.

(10) Patent No.: US 10,480,767 B2
(45) Date of Patent: Nov. 19, 2019

(54) AIR COOLED ARRAY AND SYSTEM FOR COOLING LIGHT EMITTING DIODE SYSTEMS

(71) Applicant: Air Motion Systems, Inc., River Falls, WI (US)

(72) Inventors: Michael D. Callaghan, St. Paul, MN (US); Jared J. Wertz, River Falls, WI (US)

(73) Assignee: Air Motion Systems, Inc., River Falls, WI (US)

( * ) Notice: Subject to any disclaimer, the term of this patent is extended or adjusted under 35 U.S.C. 154(b) by 134 days.

(21) Appl. No.: 15/610,517

(22) Filed: May 31, 2017

(65) Prior Publication Data

US 2017/0343202 A1 Nov. 30, 2017

Related U.S. Application Data

(60) Provisional application No. 62/343,835, filed on May 31, 2016.

(51) Int. Cl.

| | |
|---|---|
| ***F21V 29/67*** | (2015.01) |
| ***F21V 29/503*** | (2015.01) |
| ***F21V 29/61*** | (2015.01) |
| ***F21V 29/76*** | (2015.01) |
| ***F21V 23/06*** | (2006.01) |
| ***F21Y 115/10*** | (2016.01) |

(52) U.S. Cl.

CPC ..... *F21V 29/673* (2015.01); *F21V 23/06* (2013.01); *F21V 29/503* (2015.01); *F21V 29/61* (2015.01); *F21V 29/76* (2015.01); *F21Y 2115/10* (2016.08)

(58) Field of Classification Search

CPC ..... F21V 29/673; F21V 29/503; F21V 29/61; F21V 29/76; F21V 23/06; F21Y 2115/10

See application file for complete search history.

(56) References Cited

U.S. PATENT DOCUMENTS 5,413,278 A * 5/1995 Erikson ..... F24F 3/044 236/49.3
5,497,573 A * 3/1996 Stadjuhar ..... G09F 13/04 362/294
6,154,362 A * 11/2000 Takahashi ..... G09F 9/33 257/E25.028
8,558,200 B2 10/2013 Martinez et al.

(Continued)

OTHER PUBLICATIONS

The International Search Report and Written Opinion rendered by the International Searching Authority for PCT/US2017/035310, dated Aug. 14, 2017, 17 pages.

*Primary Examiner* — Mary Ellen Bowman

(74) *Attorney, Agent, or Firm* — Skaar Ulbrich Macari, P.A.

(57) ABSTRACT

An air-cooled high intensity LED light system includes an air-cooled LED array coupled to a blower device via a conduit. Each segment of the array includes a radiator thermally coupled to the LED elements to transfer heat from the LED elements to the environment. Airflow through the radiators is accomplished by creating a vacuum within the array by drawing air out of the manifold through the conduit. A blower provides the desired vacuum pressure to draw air from the environment through the radiator fins and out of the manifold. The conduit branches into individual segments so that an inlet corresponds to each of the segments of the array.

20 Claims, 6 Drawing Sheets

(56) References Cited

U.S. PATENT DOCUMENTS

| | | | | |
|---|---|---|---|---|
| 9,490,554 | B2 | 11/2016 | Brown | |
| 2003/0052584 | A1* | 3/2003 | Matsui | F21K 9/00 313/24 |
| 2006/0262079 | A1* | 11/2006 | Seong | G02F 1/133603 345/102 |
| 2007/0247847 | A1* | 10/2007 | Villard | F21K 9/00 362/249.01 |
| 2008/0101065 | A1* | 5/2008 | Hsu | F21V 29/02 362/234 |
| 2008/0315132 | A1* | 12/2008 | Platsch | F26B 3/283 250/504 R |
| 2009/0184619 | A1* | 7/2009 | Lai | F21V 29/02 313/13 |
| 2011/0292656 | A1* | 12/2011 | Saxena | F21V 29/673 362/249.02 |
| 2012/0099320 | A1* | 4/2012 | Martinez | B41J 11/002 362/249.02 |
| 2012/0268928 | A1* | 10/2012 | Sargent | H01L 33/647 362/231 |

* cited by examiner

AIR COOLED ARRAY AND SYSTEM FOR COOLING LIGHT EMITTING DIODE SYSTEMS

PRIORITY

This application claims priority under 35 U.S.C. § 119(e) to, and hereby incorporates by reference in its entirety, U.S. Provisional Application No. 62/343,835, filed May 31, 2016.

FIELD

The present invention generally relates to cooling systems for high intensity light emitting diode devices, and more particularly to air cooling devices for the same.

BACKGROUND

High intensity light emitting diode (LED) systems are often used in curing systems to emit the radiation required to effect the curing operation. U.S. Pat. No. 8,641,236 discloses one such device. The entirety of the disclosure of U.S. Pat. No. 8,641,236 is incorporated herein by reference as part of this application.

Such devices generate considerable amounts of energy. While the function of a LED is to create light radiation, a significant amount of heat is also generated. This heat energy is absorbed into the adjacent structure that thermally contacts the LED elements. Thus, the LED elements will rise to dangerous and damaging temperatures if not adequately cooled during operation. For example, the temperatures can burn a person's skin if touched, the heat can warp reflectors, warp support structures, and the heat can also cause the LED elements to prematurely fail. Thus, there have been considerable efforts to create cooling systems for high intensity LED emission systems.

One conventional system, such as provided in U.S. Pat. No. 8,641,236, circulates a liquid though a water rail defined through the longitudinal length of the LED system. This liquid cooling system is effective, but can be costly and complex to install, operate and maintain. Thus, there is a continuing need to provide effective cooling systems for high intensity LED systems.

SUMMARY

The disclosure includes an air-cooled high intensity LED light system comprising an air cooled LED array coupled to a blower device via a conduit. Each segment of the array includes a radiator thermally coupled to the LED elements to transfer heat from the LED elements to the environment. Airflow through the radiators is accomplished by creating a vacuum within the array by drawing air out of the manifold through the conduit. A blower provides the desired vacuum pressure to draw air from the environment through the radiator fins and out of the manifold. The conduit branches into individual segments so that an inlet corresponds to each of the segments of the array.

The disclosure also includes an air-cooled LED light system, comprising a manifold, blower and conduit. The manifold includes a plurality of longitudinally-disposed segments defining a longitudinal length of the manifold. A conduit is connected to the manifold and to the blower. The blower is configured to move air through the conduit to create at least one of a vacuum condition in the manifold and a pressurized condition within the manifold. The manifold includes a plurality of branches, each branch being in communication with the conduit. At least one of the plurality of branches terminates in each of the plurality of segments.

Each of the plurality of branches can be configured to maintain a consistent cooling effect for the entire longitudinal length of the manifold, or to maintain a consistent cooling effect across each of the plurality of segments, or to maintain an equal air pressure across each of the plurality of segments.

The system can also include a finned radiator disposed within each of the segments such that air moved by the blower passes across each of the finned radiators.

An LED assembly can be disposed within the manifold and thermally coupled to each of the finned radiators. The LED assembly can include a plurality of LED units disposed in side-by-side configuration, and an LED chip can be disposed on each of the plurality of LED units.

An electrical port can be disposed on the manifold and electrically coupled to the LED assembly.

A filter element is provided to an inlet of the blower, or to an opening defined in a wall of the manifold.

A diffuser can be provided to a terminal end of at least one of the plurality of branches.

A temperature sensor can be disposed within at least one of the plurality of segments.

A controller can be coupled to the temperature sensor to turn the blower ON once a temperature reading sensed via the temperature sensor rises above a preset value. The controller can further vary a speed setting of the blower as a function of the temperature reading sensed via the temperature sensor.

The disclosure additionally includes an air-cooling manifold for an LED light system. The manifold includes a plurality of longitudinally-disposed segments defining a longitudinal length of the manifold. A port is defined in the manifold for connecting a conduit. A plurality of conduit branches extend within the manifold. Each branch communicates with the port. At least one of the plurality of branches terminates in each of the plurality of segments.

Each of the plurality of branches can be configured to maintain a consistent cooling effect for the entire longitudinal length of the manifold. A finned radiator can also be disposed within each of the segments such that air passing through the plurality of branches passes across each of the finned radiators.

The LED assembly can include a plurality of LED units disposed in side-by-side configuration, wherein an LED chip is disposed on each of the plurality of LED units.

The disclosure still further includes a method of air-cooling an LED assembly. A manifold is provided that includes a plurality of longitudinally-disposed segments defining a longitudinal length of the manifold. Air is passed through a plurality of air conduit branches disposed within the manifold. At least one of the plurality of branches terminates in each of the plurality of segments. A distribution of air is balanced in each of the plurality of segments to maintain a consistent cooling effect across the entire longitudinal length of the manifold.

Air can also be passed across a finned radiator disposed within the manifold. The LED assembly can be thermally coupled to the finned radiator.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
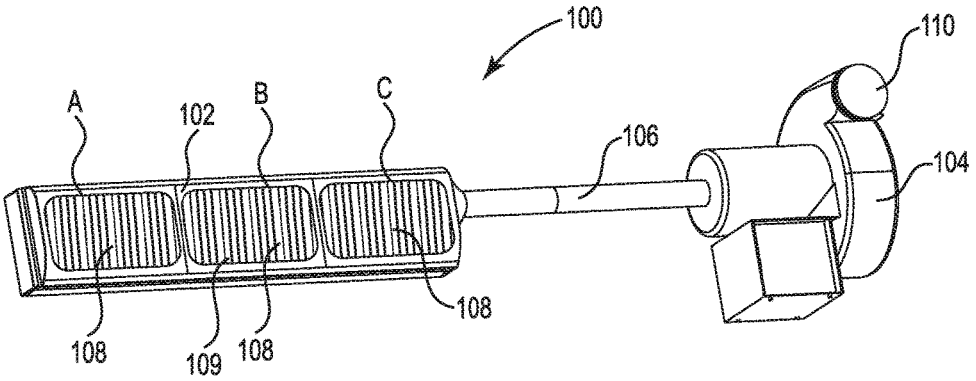
FIG. 1 is a perspective view of an air-cooled LED light system according to certain embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims.

DETAILED DESCRIPTION

In the following descriptions, the present invention will be explained with reference to example embodiments thereof. However, these embodiments are not intended to limit the present invention to any specific example, embodiment, environment, applications or particular implementations described in these embodiments. Therefore, description of these embodiments is only for purpose of illustration rather than to limit the present invention.

Referring generally to FIGS. 1-11, the air-cooled high intensity LED light system 100 generally comprises an air cooled LED array 102 coupled to a blower device 104 via a conduit 106.

The LED array or manifold 102 comprises multiple segments designated here as A, B and C. Of course, more or fewer than three segments can be provided without departing from the scope of the invention. The array 102 includes the individual LED elements, reflector and support structures as shown further in FIGS. 6-7 and 9-11, and as disclosed in U.S. Pat. No. 8,641,236.

Each manifold segment A, B, C, etc. includes a radiator component 108 that is thermally coupled to the LED elements to transfer heat from the LED elements to the environment. The finned radiator defines a plurality of parallel-aligned heat transfer structures to provide increased surface area so that significant quantities of heat energy can be dissipated into the air flowing over and through the finned radiator structures.

Airflow is accomplished by creating either a vacuum or an elevated pressure within the array manifold 102 by drawing air out of, or pressing it into, the manifold 102 through the conduit 106. A blower 104 provides the desired vacuum to draw air from the environment through the radiator fins 108 and out of the manifold 102 in a vacuum configuration. In a pressurized configuration, the blower 104 draws air from the environment and compresses the air into the conduit 106 to push the cooler air through the manifold 102 and across the heat transfer fins 108.

In a vacuum configuration, the heated air from the blower's exhaust can be routed away from the vicinity of the LED light system 100. In particular, the heated exhaust exiting through the exit port 110 of the blower 104 can be coupled to a building's HVAC system to help heat the building, for example, or routed to a water heating system to heat water for the building.

In a pressurized configuration, the blower defines an inlet 110 where cooler air from the environment is drawn in. The inlet can be connected to a conduit that supplies air from a refrigeration system, a cooling system, outside of the building, or other source.

A filter or pre-filter element 111 (shown in FIG. 3) can be provided to the system to ensure that the air traveling through the manifold does not contain selected impurities that the filter is chosen to filter out. In the vacuum embodiment, the pre-filter can be a flat filter media that is disposed over each segment's fins 108. In the positive pressurized embodiment, the filter media 111 can be disposed over the inlet 110 to the blower unit 104 or a separate filter assembly can be provided upstream of the blower 104 so that the blower ingests only filtered air. In the positive pressure embodiment, placing the filter media at the blower housing allows for filter maintenance at the blower instead of the LED lamp head, so no disassembly/interruption of use of the LED lamp is required.

The filter media can be enclosed in its own frame that secures to the manifold 102 or blower port 110, or the filter media can be disposed and secured in a portion of the manifold or blower housing that is designed to retain the media.

FIGS. 2-5, 8 and 10 show the conduit 106 branching and extending through portions of the manifold 102 with the radiators and support components removed. The manifold is shown from the rear in these figures with the rear cover or wall of the manifold removed so that the conduit portions are visible. It is understood that the manifold would have a cover or solid wall so that the manifold is enclosed other than the intended windows where the air passes over the fins 108 and where conduit passes into the manifold body 102.

The heat exchangers (radiator fins) 108 in each segment are disposed along the length of one long wall of the manifold. An opening 109 (in FIG. 1) is defined in that long wall to allow air to pass in/out of the manifold and across the radiator fins.

As can be seen in FIGS. 2-5, 8 and 10, the conduit 106 branches into individual segments 106A, 106B, 106C that each have inlets/outlets on a distal end thereof corresponding to each of the segments A, B and C of the manifold 102. Providing at least one conduit inlet/outlet in each manifold section balances the vacuum/pressure provided by the blower so that each section achieves an approximately equal cooling effect. This minimizes the potential for significant temperature gradients occurring along the longitudinal length of the LED system.

The diameters of each respective conduit segment 106A, 106B and 106C can also be varied to further tune the balance of vacuum/pressure across each segment, and therefor, achieve a longitudinally balanced cooling effect.

Figure 2:
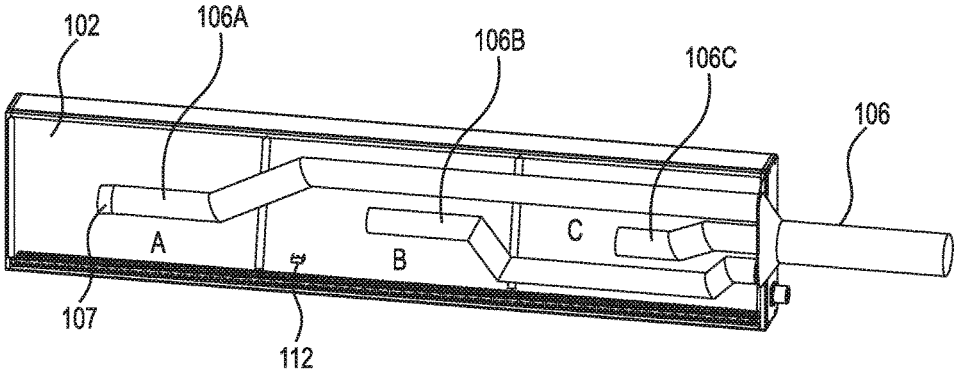
FIG. 2 is a perspective view of a cooling array for an air-cooled light system according to certain embodiments.
Figure 3:
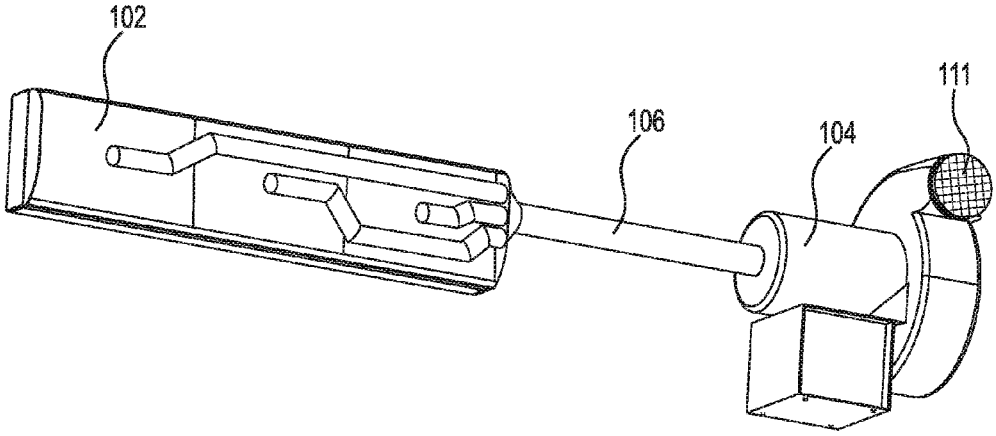
FIG. 3 is a perspective view of an air-cooled LED light system showing internal details according to certain embodiments.
Figure 4:
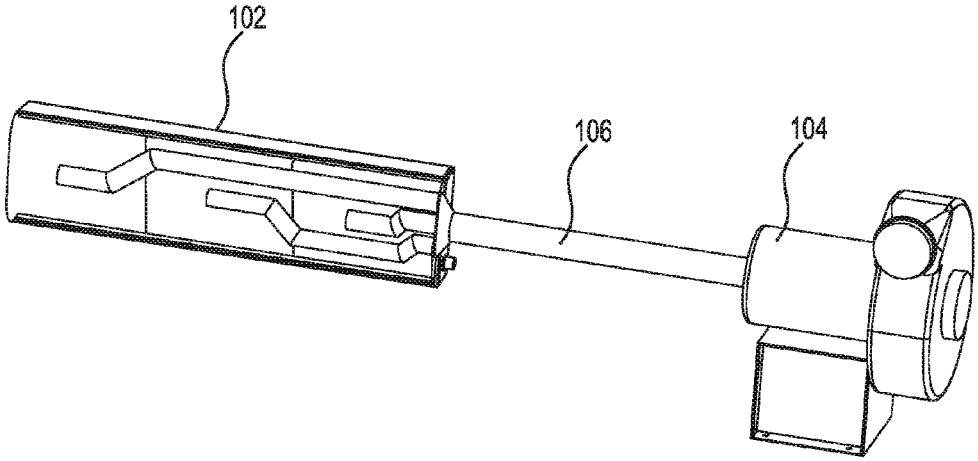
FIG. 4 is a perspective view of an air-cooled LED light system showing internal details according to certain embodiments.
Figure 5:
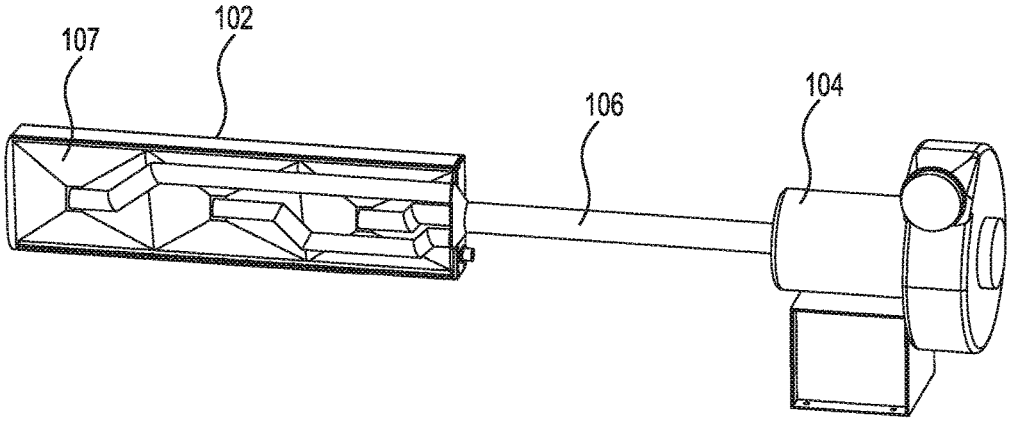
FIG. 5 is a perspective view of an air-cooled LED light system showing internal details according to certain embodiments.
Figure 6:
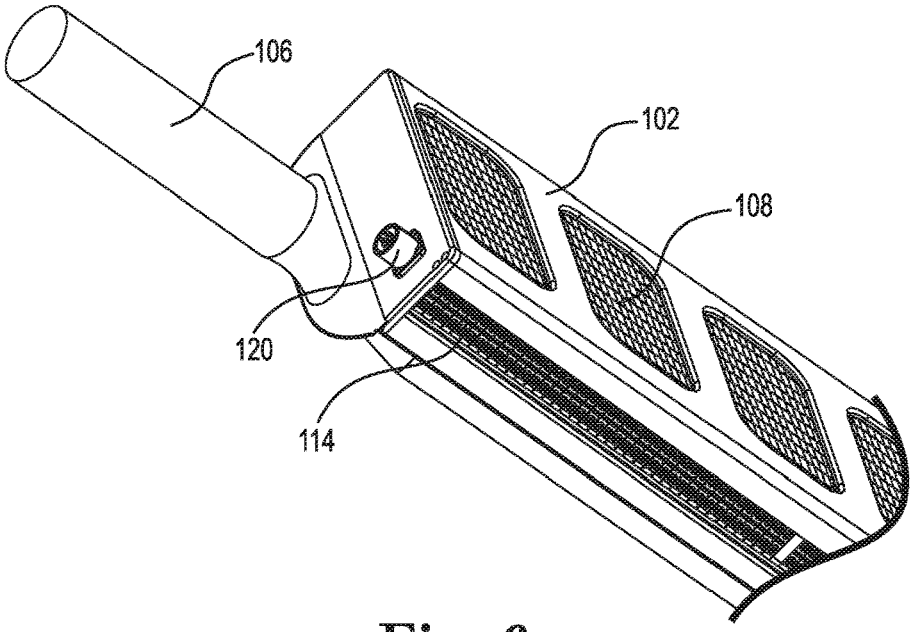
FIG. 6 is a perspective view of a portion of a cooling array for an air-cooled light system according to certain embodiments.
Figure 7:
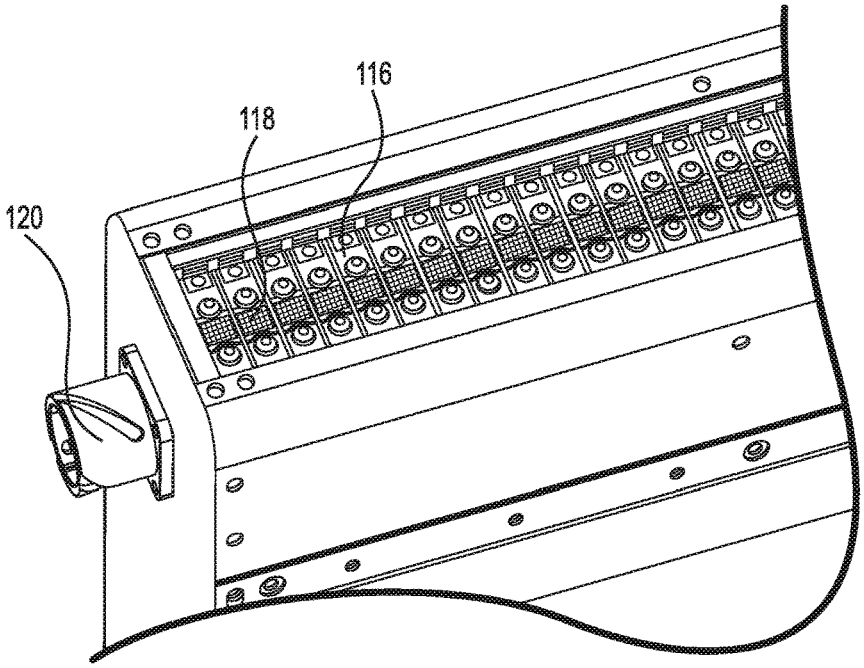
FIG. 7 is a perspective view of a portion of a cooling of FIG. 6 according to certain embodiments.
Figure 8:
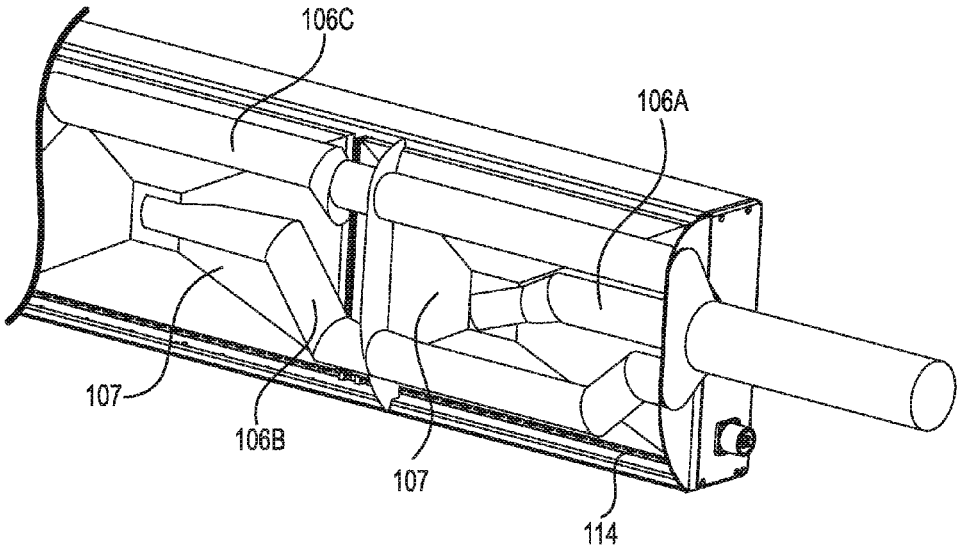
FIG. 8 is a perspective view of a portion of an air cooling manifold according to certain embodiments.
Figure 10:
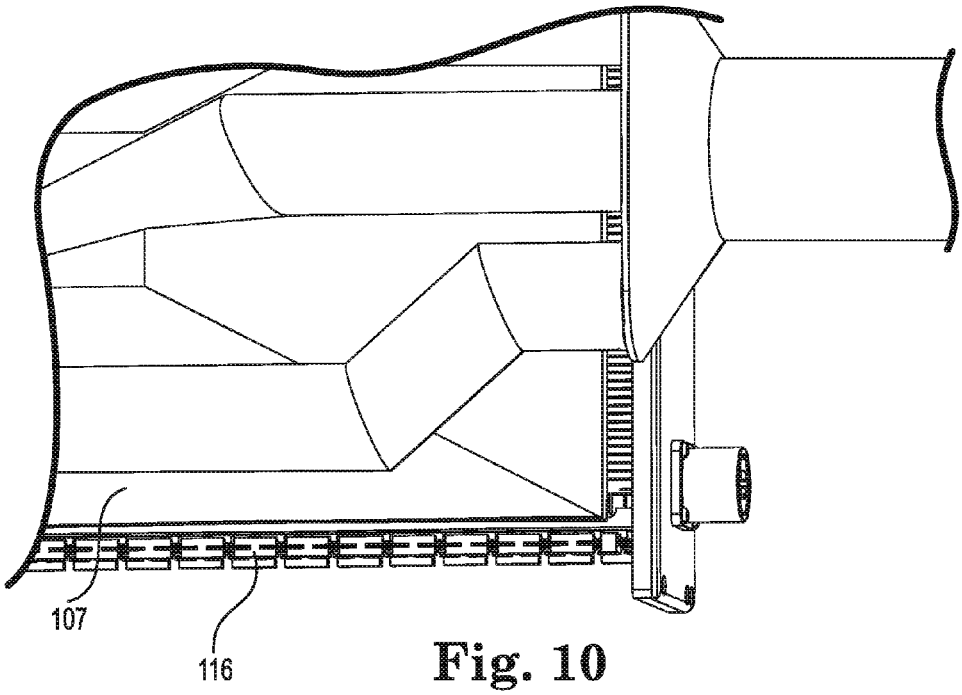
FIG. 10 is a perspective view of a portion of an air cooling manifold according to certain embodiments.

A selected diffuser 107 can be provided to one or more of the conduit terminal inlets/outlets in order to further tune the balance of pressure/vacuum within each segment. The diffuser can take several forms. A simple diffuser type is shown in FIG. 2 as provided to conduit portion 106A. An expanded diffuser 107 is shown in FIGS. 5, 8 and 10. The expanded diffuser expands the outlet of the respective conduit to be the approximate perimeter area as the finned radiator component disposed adjacent to the opening of the diffuser. This expanded diffuser functions to ensure a consistent air distribution to the radiator (or portion of a larger radiator) in that particular manifold segment.

In other alternatives, the conduits can be provided with selected apertures through their side walls, multiple inlets/outlets can be defined within each segment, or a combination of any of the foregoing can be provided.

Various components of the system, such as the radiators 108 and the manifold body 102, can be formed of heat conducting materials such as aluminum. The conduit 106 can also be a metal, or alternatively a plastic, carbon fiber or other material. The conduit, and its branches, can be electrically insulated from the rest of the structure or can be formed of a non-conductive material. The conduits can also be thermally insulated.

The radiator 108 can be a single unit that extends across multiple segments of the manifold, or separate radiators can be provided for each segment.

The blower 104 can be operated manually or can be automatically controlled. The blower can be a single speed blower or a variable speed blower. In one example, a thermocouple 112 or other temperature sensor is disposed within one or more of the segments and coupled to a controller. The controller is configured to turn the blower on once the temperature sensed by the thermocouple reaches a pre-set value. Additional temperature plateaus may be set to correspond with escalated blower speed so that additional cooling can be progressively introduced as temperatures rise. Thus, the blower can be adjusted to maintain the system below a pre-set maximum temperature.

The controller can include a processor and non-transitory memory with software programmed into the memory and executed by the processor to provide the disclosed functionality.

Referring to FIGS. 6-7, 9 and 11, the LED array or assembly 114 provided to the manifold 102 is shown. Suitable LED assemblies are disclosed in U.S. Pat. No. 9,490,554 and in U.S. Patent Application Publication 2016/0037591 A1, which are both fully incorporated herein in their entirety. The LED assembly 114 generally comprises a plurality of individual LED units 116 that are disposed side-by-side one another to define an elongated assembly. Each unit 116 includes an LED chip 118.

The elongated LED assembly 114 can be disposed in the long direction along a wall of the manifold 102. An opening is provided so that the light from the LED units can shine outward to the desired location. The light can be either direct projection or can be reflected off of an internal reflector such as disclosed in U.S. Pat. No. 8,641,236. A window formed of glass, plastic or other suitable material can be provided to cover the opening in the wall through which the light from the LEDs passes.

Power port 120 can be defined in an end wall of the manifold 102 body so that power can be provided to the LED assembly 114.

Figure 9:
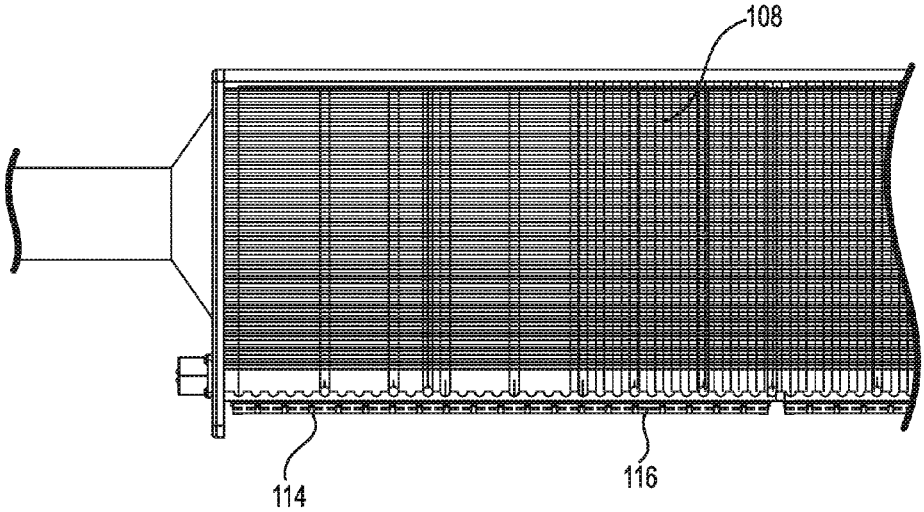
FIG. 9 is a perspective view of a portion of an air cooling manifold according to certain embodiments.
Figure 11:
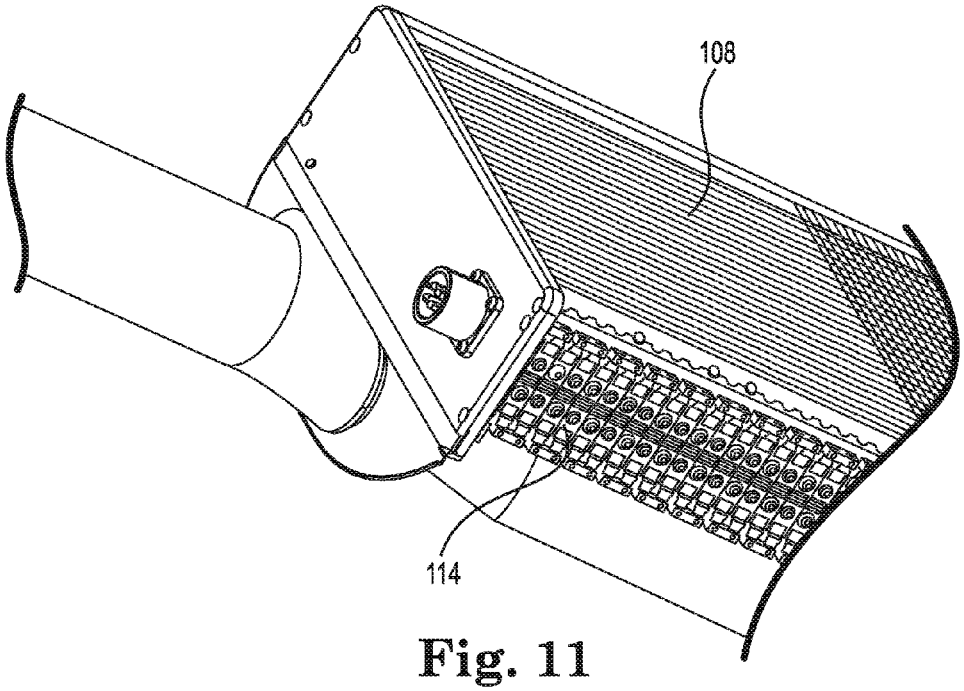
FIG. 11 is a perspective view of a portion of an air cooling manifold according to certain embodiments.

Referring to FIGS. 9-11, the radiator 108 is thermally coupled to the LED assembly 114, either directly or indirectly, so that heat generated by each of the LED units 116 is transferred to the radiator fins so that the heat can be dissipated by the movement of air over the fins. Note that the front cover is removed in FIGS. 9 and 11, and the rear cover is removed in FIGS. 8 and 10.

The manifold 102 for the light system 100 can be provided in any desired length and with any desired number of segments. Multiple separate manifolds can also be joined together via an intermediate conduit spanning from one to the next in order to supply pressurized cooling air or a vacuum.

The present invention allows a single blower 104 to be used and conveniently located remote from the LED array 114 with only a single conduit 106 extending between the blower 104 and the manifold 102. The LED array 114 can thus be configured with a low profile so that it can be disposed in machinery (e.g. printing presses) where size clearance is critical. Only one blower is needed, so maintenance and complexity of the system is minimized.

In pressurized embodiments, compressed air can be introduced to the conduit 106 via a pressurized air tank, a bellows, a compressor or other means for supplying compressed air into a conduit.

In a positive pressure embodiment, heated air (i.e. above ambient temperature) can be introduced to the blower of the conduit outside of the manifold so that heat is introduced into the manifold, if desired.

The present invention advantageously avoids air disturbances at the LED head for sensitive applications (such as digital printing).

Since the system is self-contained versus an open fan blowing over the LED assembly, ambient contaminants (such as ink) are not passed through the radiators.

Removing heat from the LED assembly pulls heat from the LED chip surfaces, which increases LED output and useful operational life.

The contained system with a remote location of the blower reduces noise at the LED head location which improves the working area for operators.

The present invention may be embodied in other specific forms without departing from the spirit or essential attributes thereof, and it is, therefore, desired that the present embodiment be considered in all respects as illustrative and not restrictive. Those skilled in the art may recognize other equivalents to the specific embodiments described herein which equivalents are intended to be encompassed by the claims attached hereto.

What is claimed is:

1. An air-cooled LED light system, comprising:

a manifold, comprising a plurality of longitudinally-disposed separated segments defining a longitudinal length of the manifold;

a blower; and an inlet conduit connected to the manifold and to the blower, wherein the blower is configured to move air through the inlet conduit to create at least one of a vacuum condition within the manifold and a pressurized condition within the manifold, wherein the manifold includes a plurality of conduit branches disposed inside of the manifold, each branch being in communication with the inlet conduit, and wherein at least one of the plurality of conduit branches terminates within each of the plurality of segments.

2. The system of claim 1, wherein each of the plurality of conduit branches is configured to maintain a consistent cooling effect for the entire longitudinal length of the manifold.

3. The system of claim 1, wherein each of the plurality of conduit branches is configured to maintain a consistent cooling effect across each of the plurality of segments.

4. The system of claim 1, wherein each of the plurality of conduit branches is configured to maintain an equal air pressure across each of the plurality of segments.

5. The system of claim 1, further comprising a finned radiator disposed within each of the segments such that air moved by the blower passes across each of the finned radiators.

6. The system of claim 5, further comprising a light emitting diode (LED) assembly disposed within the manifold and thermally coupled to each of the finned radiators.

7. The system of claim 1, further comprising an LED assembly disposed within the manifold.

8. The system of claim 7, wherein the LED assembly comprises a plurality of LED units disposed in side-by-side configuration, wherein an LED chip is disposed on each of the plurality of LED units.

9. The system of claim 7, wherein an electrical port is disposed on the manifold and electrically coupled to the LED assembly.

10. The system of claim 1, wherein a filter element is provided to an inlet of the blower.

11. The system of claim 1, wherein a filter element is provided to an opening defined in a wall of the manifold.

12. The system of claim 1, wherein a diffuser is provided to a terminal end of at least one of the plurality of conduit branches.

13. The system of claim 1, further comprising a temperature sensor disposed within at least one of the plurality of segments.

14. The system of claim 13, further comprising a controller coupled to the temperature sensor, the controller configured to turn the blower ON once a temperature reading sensed via the temperature sensor rises above a preset value.

15. The system of claim 14, wherein the controller is further configured to vary a speed setting of the blower as a function of the temperature reading sensed via the temperature sensor.

16. An air-cooling manifold for an LED light system, the manifold comprising:

a plurality of longitudinally-disposed segments defining a longitudinal length of the manifold;

a port for connecting an inlet conduit; and a plurality of conduit branches disposed inside of the manifold, each conduit branch being in communication with the port, wherein at least one of the plurality of conduit branches terminates within each of the plurality of segments.

17. The manifold of claim 16, wherein each of the plurality of conduit branches is configured to maintain a consistent cooling effect for the entire longitudinal length of the manifold.

18. The manifold of claim 16, further comprising a finned radiator disposed within each of the segments such that air passing through the plurality of conduit branches passes across each of the finned radiators.

19. A method of air-cooling an LED assembly, the LED assembly comprising a plurality of LED units disposed in side-by-side configuration, wherein an LED chip is disposed on each of the plurality of LED units, the method of air-cooling comprising:

defining a manifold including a plurality of longitudinally-disposed segments defining a longitudinal length of the manifold;

passing air through a plurality of air conduit branches that are disposed inside of the manifold;

terminating at least one of the plurality of air conduit branches in each of the plurality of segments; and balancing a distribution of air in each of the plurality of segments to maintain a consistent cooling effect across the entire longitudinal length of the manifold.

20. The method of claim 19, further comprising:

passing air across a finned radiator disposed within the manifold; and thermally coupling the LED assembly to the finned radiator.

* * * * *